US005524292A

United States Patent [19]

Hargens

[11] Patent Number: 5,524,292

[45] Date of Patent: Jun. 11, 1996

[54] KNEE PAD UNIT

[76] Inventor: Michael Hargens, P.O. Box 893, Homewood, Ill. 60430

[21] Appl. No.: 323,117

[22] Filed: Oct. 14, 1994

[51] Int. Cl.[6] ..... A41D 13/06

[52] U.S. Cl. ..... 2/24; 2/911; 2/DIG. 3

[58] Field of Search ..... 2/2, 22, 23, 24, 2/267, 413, 62, DIG. 3, 911

[56] References Cited

U.S. PATENT DOCUMENTS

| | | | |
|---|---|---|---|
| 830,661 | 9/1906 | Gresham | 2/24 |
| 871,760 | 11/1907 | Long | 2/24 |
| 1,055,040 | 3/1913 | Herron | 2/24 |
| 1,090,446 | 3/1914 | Boynton . | |
| 2,093,888 | 9/1937 | Holtje | 2/24 |
| 3,994,021 | 11/1976 | Villari et al. | 2/413 |
| 4,120,052 | 10/1978 | Butler | 2/24 X |
| 4,378,009 | 3/1983 | Rowley et al. | 2/24 X |
| 5,220,691 | 6/1993 | Wiegers | 2/24 |

*Primary Examiner*—Paul C. Lewis
*Attorney, Agent, or Firm*—Myers & Associates, Ltd.

[57] ABSTRACT

A knee pad unit for protecting the knee of an individual in a kneeling position and having outer plastic shell and a plurality of inflatable pneumatic tubes attached within the shell. The shell has two exterior rails having a front portion formed in a curved configuration to permit rocking. The plurality of inflatable tubes includes a central ring for suspending the knee and rear tubes for suspending the upper leg.

11 Claims, 2 Drawing Sheets

KNEE PAD UNIT

BACKGROUND OF THE INVENTION

1. Field of the Invention

This invention relates in general to body pads for use by individuals and more specifically, to a knee pad for an individual in the kneeling position.

2. Description of Prior Art

In many occupations, it is necessary for workers to kneel on hard surfaces for long periods of time. Because of the biological structure of a knee, an individual must endure discomfort and possibly injury when kneeling for any sustained duration. In professions, such as tilers, carpet layers, carpenters, and others, the person must work in a kneeling position for a long period of time to perform his tasks. Numerous types of pads and cushions have been developed in the past to help make the knee more comfortable and free of pressure while an individual knee is supported on a hard surface.

Examples of known knee pads are disclosed in U.S. Pat. No. 830,661 to Gresham; U.S. Pat. No. 1,090,446 to Boynton, and U.S. Pat. No. 5,220,691 to Wiegers. Although prior knee pad designs, including the structures shown in the foregoing patents, offer some degree of comfort, they are deficient in providing maximum comfort to the wearer through effective distribution of the pressure applied to the knee and leg when kneeling on hard surfaces. Accordingly, it is desirable to provide an improved knee pad device capable of comfortly protecting a knee and leg in a kneeling position over long periods of time.

SUMMARY OF THE INVENTION

It is therefore an objective of the invention to provide an improved knee pad unit for comfortably supporting the knee of an individual in a kneeling position for extended periods of time. The knee pad unit herein disclosed includes an outer hard shell in which an inflated rail cushion is situated. The rail cushion distributes the weight of the individual in a manner to relieve pressure being applied to the knee cap, lower leg and thigh. The benefits of effective weight distribution in the invention are combined with a unique configuration which provides the user with balance and the ability to rock back and forth while performing any task. The knee pad of the application greatly enhances the comfort of an individual over more extended periods of time than possible in known devices and helps relieve the undue stress resulting from kneeling.

DESCRIPTION OF THE PREFERRED EMBODIMENT

Figure 1:
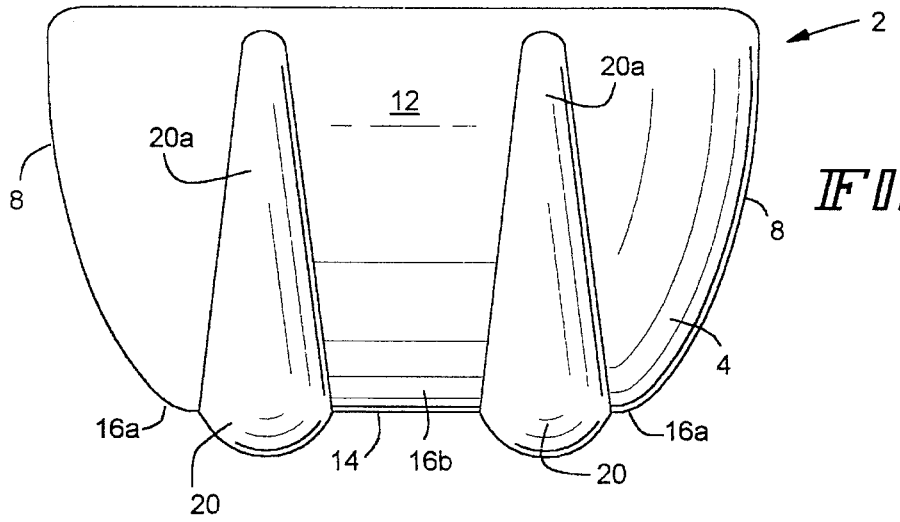
FIG. 1 is a front elevational view of the knee pad device of the invention.
Figure 2:
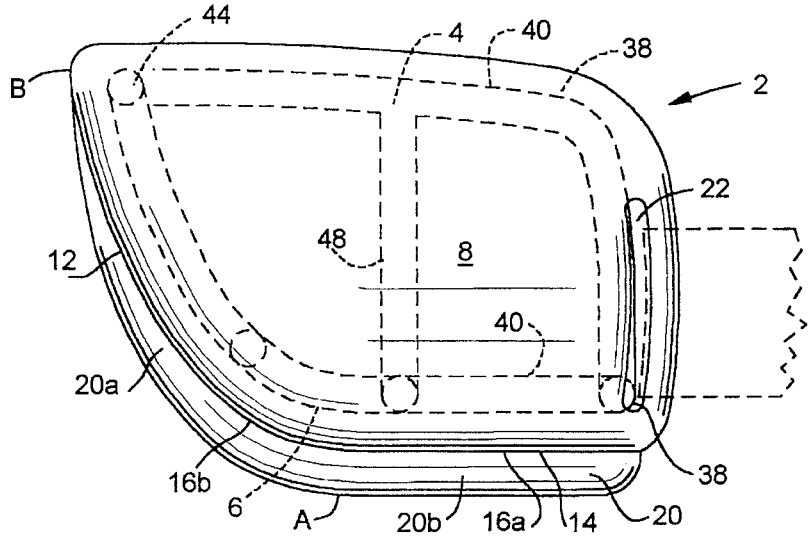
FIG. 2 is a side elevational view of the knee pad device of FIG. 1.
Figure 3:
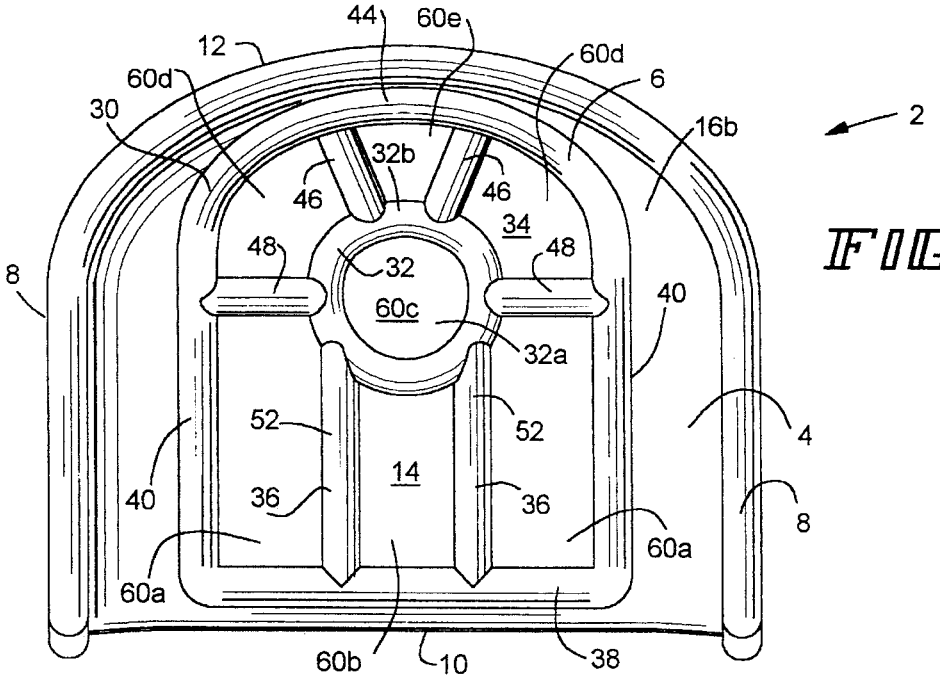
FIG. 3 is a top plan view of the knee pad device of FIG. 1.
Figure 4:
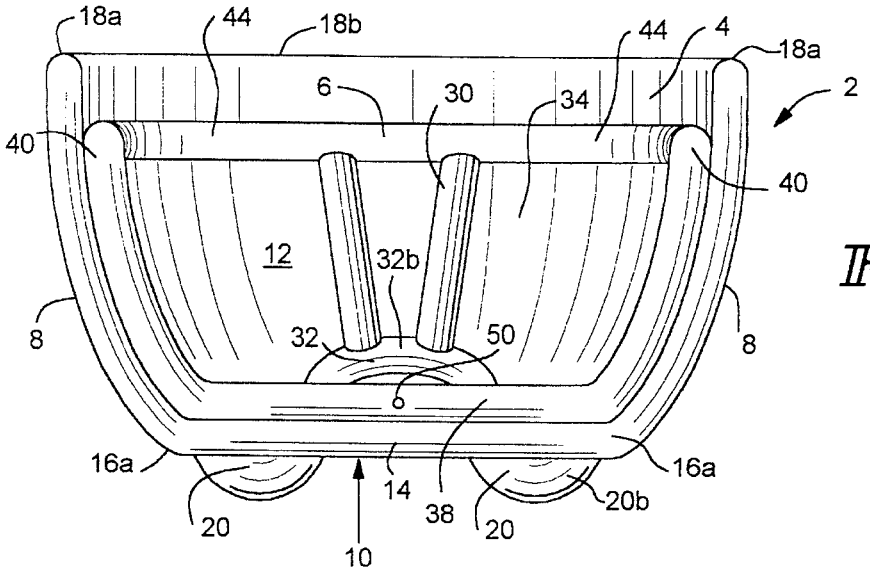
FIG. 4 is a rear elevational view of the knee pad device of FIG. 1.

Referring now to FIGS. 1 to 6, there is illustrated the improved knee pad unit of the invention, generally designated by reference numeral 2. The knee pad unit 2 is intended to be worn by an individual while kneeling for performing numerous tasks in a wide range of occupations and situations. The knee pad unit 2 includes a hard outer shell 4 formed of a suitably durable material, such as a molded plastic, and an inner inflated tubular cushion 6 as seen in FIGS. 2, 3, 4 and 5. The outer shell 4 is an integral structural having a pair of side walls which flair outward 8 (FIG. 1) and a open rear 10 (FIG. 4). The front wall 12 curves outward from sidewalls 8 (FIG. 3). A bottom wall 14 having a generally flat shape is formed as the base of shell 4 and is integrally connected to side walls 8 and front wall 12 through curved intermediate portions **16*a*, 16*b*. The upper edges 18*a*, 18*b* of side walls 8 and front wall 12** possess a generally rounded upper edge configuration. It is within the scope of the invention to mold the outer shell as a solid or hollow plastic structure as desired.

Figure 5:
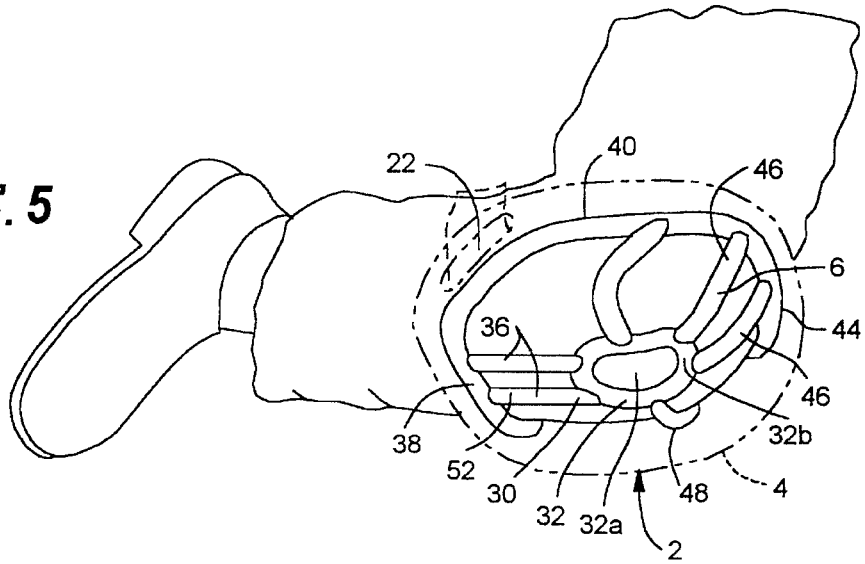
FIG. 5 is a front perspective view, with the outer shell shown in phantom, of the knee pad device of FIG. 1 being worn by an individual.
Figure 6:
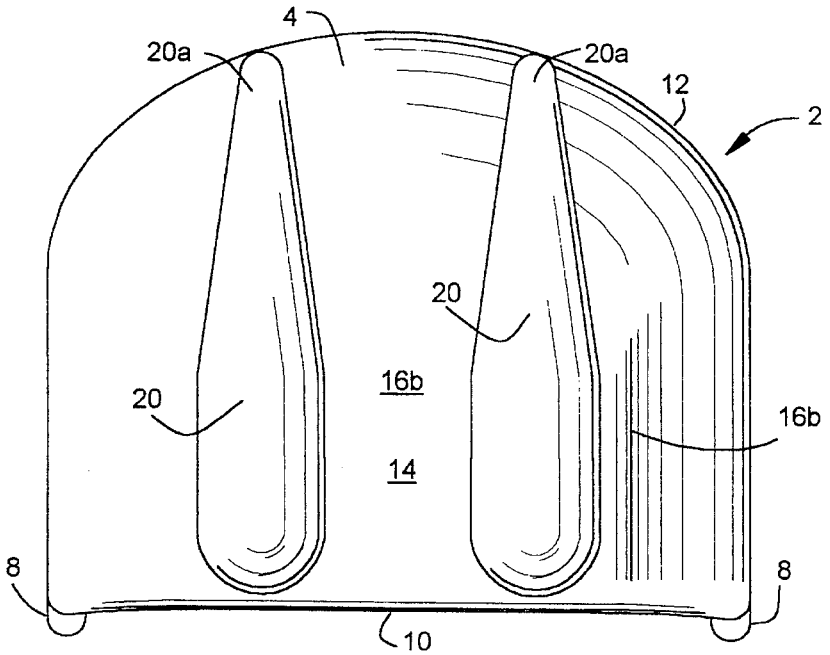
FIG. 6 is a bottom plan view of the knee pad device of FIG. 1.

A pair of spaced rounded external rails 20 extend from adjacent the rear of shell 4 and extend along the bottom wall 14 upward along curved intermediate portion **16*b* and vertically along the exterior of front wall 12. As seen in FIGS. 1 and 2, the width and thickness of upper portion 20*a* of the rails 20 gradually diminish in an upward direction whereas the outer edge of the upper portion 20*a* is curvilinear in configuration between point A at a generally horizontal point below the bottom wall 14 to a upper point B (FIG. 2). In addition, the cross sections of rails 20 along the wall 14, intermediate portion 16*b*, and front wall 12 are generally curved as seen in FIG. 1 and 4. The heights of the bottom portion 20*b* of rails 20 are approximately constant along bottom wall 12 up to intermediate portion 16*b* as seen in FIGS. 2 and 4. The exterior configuration of the rails 20 permits the wearer to rock back and forth when pivoting or leaning forward. As seen in FIGS. 2 and 5, a pair of gradually curved slots 22 are vertically formed in the rear portion of side walls 8 to retain a strap having interlocking loops and hooks, such as sold under the trademark VELCRO for affixing shell 4 on an individual's knee. The knee pad unit 2 is secured to the knee with a wide strap (shown in phantom) that is attached to one of slots 22, crosses the back of the individual's leg, loops back through the other slot 22** and recrosses the back of the leg with VELCRO closure (not shown).

Referring now to FIGS. 2, 3, 4 and 5, the inner tubular knee cushion 6 is illustrated. The cushion 6 includes a plurality of hollow, inflatable tubes 30 of rubber and the like being in fluid communication with each other and being affixed to the shell by VELCRO fasteners (not shown). The plurality of tubes 30 includes a central tubular patellar ring 32 to form a knee cap receiving area **32*a* as seen in FIG. 3 and suspend the knee above bottom wall 14**.

As seen in FIG. 4, the forward portion **32*b* of the tubular ring 32 bears against the sloped inner face 34 of the intermediate shell portion 16*b*. A pair of rearwardly extending tubes 36 extend along bottom wall 14 outward in fluid communication with a rear lateral inflatable tube 38 disposed in shell 4. The ends of rear tube 38 curve vertically and are in fluid communication with a pair of inflatable rim tubes 40 which horizontally extend to the front wall 12. The front portion of side tubes 40 at front wall 12 of shell 4 continue in fluid communication with a bowed end rim section 44 (FIGS. 3, 4, 5) of tubular construction. A pair of front tubular spokes 46 project upward between the front of the ring 32 and the bowed tubular end section 44. A pair of lateral tubular spokes 48 (FIG. 3) interconnect the sides of ring 32 to the border tubes 40. The entire network of tubes in cushion 6 is inflated through orifice 50 (FIG. 4) in the rear tube 38** by a hand held air pump and the like.

The cushion 6 performs different functions at various anatomical locations of the knee and leg of the wearer. As seen in FIG. 5, the shell 4 and cushion 6 are strapped over the knee of the user for kneeling. The open area 32*a* receives the central portion of the individual's knee cap (patella) in elevated support on ring 32 which acts as a patellar support while the user is in a kneeling position. Thus, a major portion of the user's weight is supported by the surrounding knee structure and not the patella by itself.

The two rearwardly extending tubes 36 extend inferiorly relative to the caudal portion of the patellar ring 32 and provide an upper surface 52 to support the media and lateral tissue of the user adjacent to the medial and lateral surface surface of the tibia (upper lower leg) in suspended relation above the bottom surface 14. Support of the upper leg on surfaces 52 also lessens the pressure on the user's knee and lower leg by further distributing and supporting the users weight.

The rim of the cushion 6 is formed by side tubes 40 and tubular end section 44 serves as the connecting means of the entire structure and also gives additional support to medial and lateral knee as well as the anterior lower thigh region. The rear tube 38 serves to connect the rim (tubes 40) and the upper leg supporting tubes 36. The front tubes or tubular spokes 46 extend upward from the cephalic portion of the patellar ring 32 and join the upper tubular end section 44 at the anterior portion of the lower thigh of the individual. The tubes 44, 46 act to support the knee when the user pivots forward. Tubular spokes 48 extend outward from the medial and lateral portion of the patellar ring 32 and join the side rim tubes 40 at the medial and lateral portion of the lower thigh. The open areas 60*a, b, c, d* and *e* between the tubes 30 (FIG. 3) allow air circulation to non-supported parts of the knee structure for better comfort.

What is claimed is:

1. A knee pad device comprising shell means for attachment to the leg of an individual over the knee cap, said shell means having an open leg receiving top defined by a bottom wall, a pair of spaced side walls integrally connected to said bottom wall and an integral front wall disposed between said side walls and extending upward from said bottom wall, said bottom wall and said pair of spaced side walls having rear end portions forming an opening for receiving the leg of the individual, cushion means arranged to be affixed within said shell in contact with a portion of said bottom wall and a portion of said front wall, said bottom wall and said front wall having an external surface permitting said shell to be rocked back and forth, said cushion means having a plurality of inflatable tubes, said plurality of inflatable tubes includes a central tubular ring for receiving the knee cap of the individual in suspended position in said shell means, said front wall forms an upwardly sloped internal surface, said plurality of inflatable tubes having an upwardly extending portion in contact with said internal surface for contacting a portion of the leg of an individual, said plurality of tubes includes a pair of inflatable rim tubes extending along said side walls and an end tube disposed substantially on said front wall in fluid communication with said rim tubes, and said plurality of inflatable tubes includes a rear inflatable tube extending between said pair of rim tubes for contacting the lower leg portion of an individual.

2. The knee pad device according to claim 1 wherein said plurality of tubes further includes a pair of rearwardly extending inflatable tubes disposed in fluid communication with said tubular ring and said rear tube, said pair of inflatable tubes and said rear tube acting to support the lower leg of an individual in a kneeling position.

3. The knee pad device according to claim 2 wherein said plurality of tubes further includes medial and lateral tubes extending between and in fluid communication with said tubular ring and a respective one of said rim tubes.

4. The knee pad device according to claim 2 wherein said plurality of inflatable tubes are spaced to form a plurality of open areas for providing circulation when worn by an individual.

5. The knee pad device according to claim 1 wherein said shell means includes an external front surface having a curved configuration to permit said shell means to be rocked when worn.

6. The knee pad device according to claim 5 wherein said curved configuration of said external front surface is formed by a pair of spaced external rails.

7. The knee pad device according to claim 6 wherein said pair of rails extend along the bottom of said bottom wall.

8. The knee pad device according to claim 7 wherein said pair of rails have a curved outer surface in cross section.

9. A knee pad device comprising shell means for attachment to the leg of an individual over the knee cap, said shell means having a bottom wall, a pair of spaced side walls integrally connected to said bottom wall and an integral front wall disposed between said side walls and extending upward from said bottom wall, cushion means arranged to be affixed within said shell in contact with at least said bottom wall, said cushion means having a plurality of inflatable tubes, said shell means includes an external front surface having a curved configuration to permit said shell means to be rocked when worn, said curved configuration of said external front surface is formed by a pair of spaced external rails, said pair of rails extend along the bottom of said bottom wall, said pair of rails have a curved outer surface in cross section, and said pair of rails have a varying thickness and width along said front surface.

10. The knee pad device according to claim 9 wherein said pair of rails have a generally uniform thickness and width along said bottom wall.

11. A knee pad device comprising shell means for attachment to the leg of an individual over the knee cap, said shell means having a bottom wall, a pair of spaced side walls integrally connected to said bottom wall and an integral front wall disposed between said side walls and extending upward from said bottom wall, cushion means arranged to be affixed within said shell in contact with at least said bottom wall, said cushion means having a plurality of inflatable tubes, said shell means includes an external surface having a curved configuration between said front wall and said back wall said shell means includes a pair of spaced external rails extending between said front wall and said back wall over said external surface.

* * * * *